US007492247B2

(12) United States Patent
Schmidt et al.

(10) Patent No.: US 7,492,247 B2
(45) Date of Patent: Feb. 17, 2009

(54) TRANSMITTER HEAD AND SYSTEM FOR CONTACTLESS ENERGY TRANSMISSION

(75) Inventors: Josef Schmidt, Graben Neudorf (DE); Günter Becker, Östringen (DE); Leobald Podbielski, Karlsruhe (DE); Martin Nürge, Mannheim (DE)

(73) Assignee: Sew-Eurodrive GmbH & Co. KG, Bruchsal (DE)

( * ) Notice: Subject to any disclaimer, the term of this patent is extended or adjusted under 35 U.S.C. 154(b) by 385 days.

(21) Appl. No.: 10/550,085

(22) PCT Filed: Feb. 20, 2004

(86) PCT No.: PCT/EP2004/001660

§ 371 (c)(1),
(2), (4) Date: Sep. 19, 2005

(87) PCT Pub. No.: WO2004/084372

PCT Pub. Date: Sep. 30, 2004

(65) Prior Publication Data

US 2006/0209487 A1 Sep. 21, 2006

(30) Foreign Application Priority Data

Mar. 19, 2003 (DE) ..... 103 12 284

(51) Int. Cl.
*H01F 5/00* (2006.01)

(52) U.S. Cl. ..... 336/200

(58) Field of Classification Search ..... 336/55–62, 336/65, 83, 200, 232; 307/104
See application file for complete search history.

(56) References Cited

U.S. PATENT DOCUMENTS

| | | | | |
|---|---|---|---|---|
| 6,005,304 | A | 12/1999 | Seelig | |
| 6,369,685 | B1 | 4/2002 | Milavec et al. | |
| 6,407,470 | B1 | 6/2002 | Seelig | |
| 6,462,432 | B1 | 10/2002 | Seelig et al. | |
| 6,466,454 | B1 * | 10/2002 | Jitaru | 361/836 |
| 2002/0036561 | A1 * | 3/2002 | Jedlitschka | 336/232 |
| 2004/0051628 | A1 | 3/2004 | Uhi | |

OTHER PUBLICATIONS

Translation of International Preliminary Report on Patentability from International Application No. PCT/EP2004/001660, Mar. 2, 2006.

* cited by examiner

*Primary Examiner*—Tuyen T. Nguyen
(74) *Attorney, Agent, or Firm*—Kenyon & Kenyon LLP

(57) ABSTRACT

A transmitter head for a system for contactless energy transmission includes a support connected to at least one ferrite core. The ferrite core is embodied at least partially in the E-form and a flat winding is arranged around one leg of the E.

12 Claims, 5 Drawing Sheets

TRANSMITTER HEAD AND SYSTEM FOR CONTACTLESS ENERGY TRANSMISSION

FIELD OF THE INVENTION

The present invention relates to a transmitter head and a system for contactless energy transmission.

BACKGROUND INFORMATION

German Published Patent Application No. 100 53 373 describes a device for contactless energy transmission, in which a transmitter head permits inductive energy transmission and has a number of turns per unit length.

German Published Patent Application No. 44 46 779 and German Published Patent Application No. 197 35 624 describe a system for contactless energy transmission, in which the path is made up of a stationary neutral conductor, and an aluminum profile as a return line. The neutral conductor is surrounded by a U-shaped core of the transmitter head, the core being movable along the neutral conductor. A winding is provided on the U-shaped core. The transmitter head may require a large unit volume.

PCT International Published Patent Application No. WO 92/17929 describes a system for contactless energy transmission, in which the transmission path is made up of a forward line and a return line in the form of line conductors. The transmitter head implemented with an E-shaped core and a winding disposed on the middle limb of the E-shaped core may require a large unit volume.

German Published Patent Application No. 197 46 919 describes a flat arrangement which, however, may result in low efficiency in the energy transmission.

SUMMARY

An example embodiment of the present invention may provide a system for contactless energy transmission which may provide a smaller unit volume in an inexpensive and uncomplicated manner.

The transmitter head for a system for contactless energy transmission may include a support connected to at least one ferrite core, the ferrite core being at least partially E-shaped, and the flat winding being disposed about one limb of the E. The transmitter head may be adapted for an electrical energy-transmission device having a primary-conductor arrangement made of at least two primary conductors extending parallel to each other and at least one secondary-winding arrangement, electromagnetically coupled thereto, which is mechanically separated from the primary-conductor arrangement and is movable in its longitudinal direction. The secondary-winding arrangement has at least one secondary coil which is in the form of a flat winding and which is arranged in a plane situated parallel to the plane accommodating the primary-conductor arrangement. The transmitter head includes a support connected to at least one ferrite core, the ferrite core being at least partially E-shaped, and the flat winding being provided about one limb of the E-shaped ferrite core.

The transmitter head may be very flat, may be cost-effective, and may require a small unit volume. In addition, the efficiency of the energy transmission may be much higher, since the E-shaped arrangement may conduct the field lines such that fewer stray fields may develop, and the majority of the field lines generated by the primary lines or conductors may be conducted through the ferrite core having the limbs of the E.

The primary conductors may be formed as line conductors, or the primary conductors may be formed as flat conductors whose surface normal is perpendicular to the plane accommodating the secondary-winding arrangement. High current densities may be achievable, litz-wire material may be useable, and therefore the skin effect may be reducible.

The secondary-winding arrangement may be disposed at the lower side of the floor of a vehicle. This may provide that a rail system is useable in the same manner as a system without rails.

The secondary-winding arrangement may be embedded in a potting or casting compound. This may provide that a high degree of protection is attainable.

The primary-conductor arrangement may be disposed in stationary manner in the near-surface region of a travel path. This may provide that high efficiency may be attainable in the energy transmission.

The primary-conductor arrangement and/or the secondary-conductor arrangement may be formed at least partially of litz-wire material. This may provide that it may be possible to reduce the skin effect.

The flat winding may be implemented as a conductor track on a single-layer or multilayer board. This may provide that it may be possible to produce the transmitter head particularly inexpensively.

The board may also be fitted with electronic components. This may provide that the number of components may be reducible, e.g., the number of devices for electrical and/or mechanical connection may be reducible.

The board may be connected to a housing part encompassing a cooling device. In particular, the cooling device has cooling fins and/or cooling fingers. This may provide that the heat may be able to be transmitted from the housing part to the cooling device.

Features hereof with respect to the system for contactless energy transmission using a transmitter head may include that two line conductors are laid in the floor with a mutual distance A, the distance of the transmitter head from the floor being between 0.05*A and 0.2*A. This may provide that great powers may be able to be transmitted, accompanied by particularly small unit volume.

LIST OF REFERENCE NUMERALS

1 Support
2 Ferrite cores
3 Layer of a multilayer board
4 Layer of a multilayer board
5 Layer of a multilayer board
21 Housing part
22 Cooling fins
23 Electronic components
24 Ferrite cores
25 Winding
26 Board
31 Ferrite core
32 Plastic molded part
33 Litz wire
41 Floor
42 Line conductor
43 Housing part
A,B Distance Example embodiments of the present invention are explained in more detail with reference to the appended Figures.

DETAILED DESCRIPTION

Figure 1A:
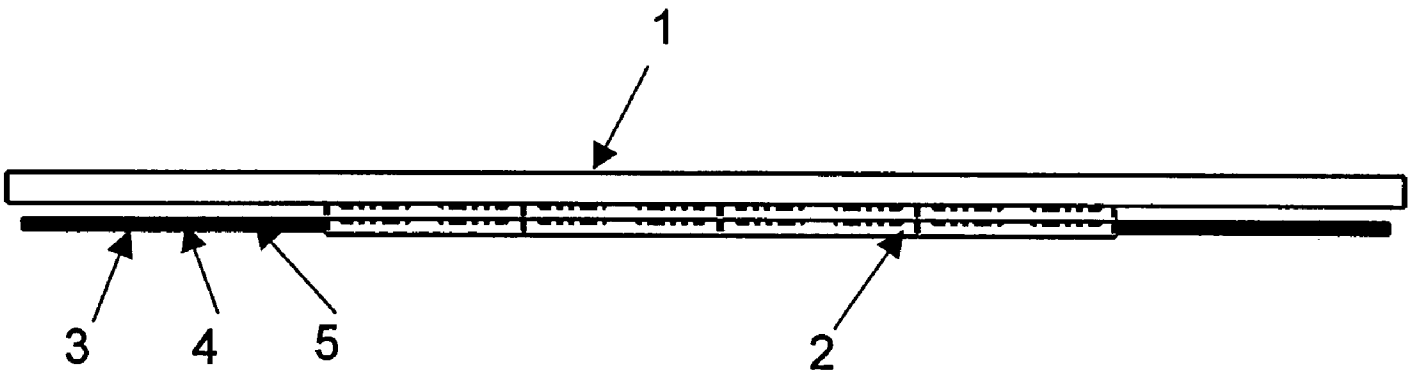
FIG. 1*a* is a schematic view of a transmitter head of an example embodiment of the present invention.
Figure 1B:
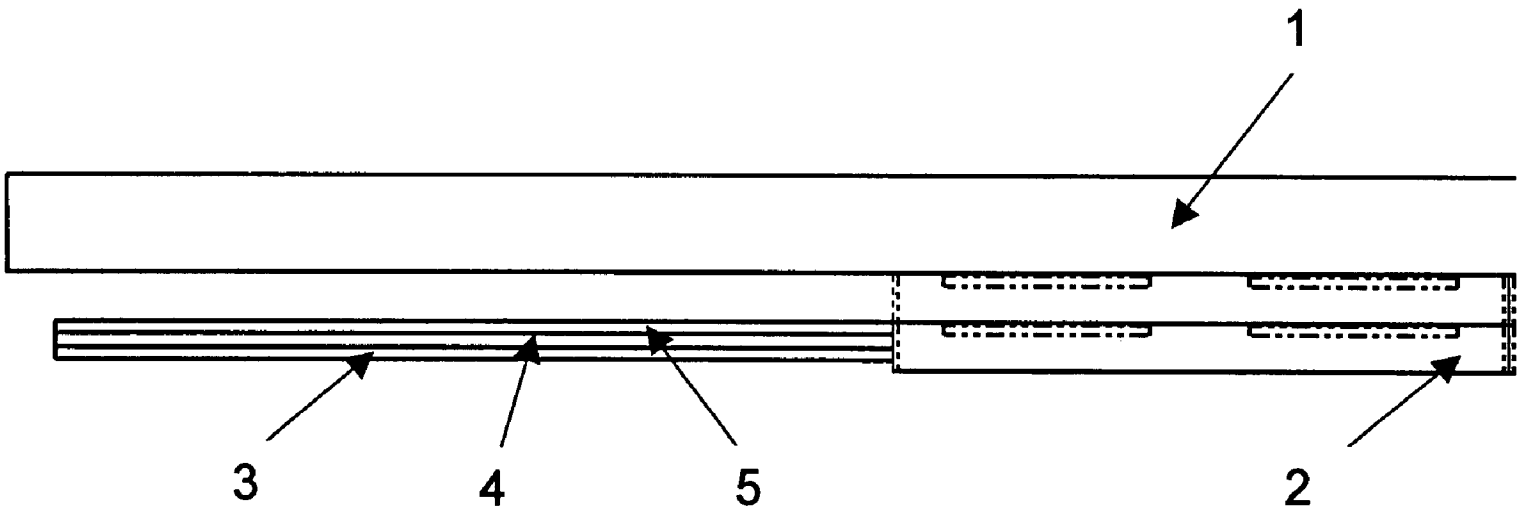
FIG. 1*b* is an enlarged view of a left end area of the transmitter head illustrated in FIG. 1*b*.

FIG. 1*a* illustrates a transmitter head of an example embodiment of the present invention, an enlarged section of the left end area being illustrated schematically in FIG. 1*b*. It may be flat and may need a small unit volume.

Ferrite cores 2 are mounted on and connected to support 1, using, for example, an adhesive connection or a releasable connection such as a screw connection, etc.

Provided at ferrite cores 2 is a multilayer board having layers (3, 4, 5) which bear copper conductor tracks that take the form of flat windings, and thus are implemented on the board.

In an exemplary embodiment of the present invention, a single, planar, spiral winding may be provided as a conductor track of a single-layer board, less electrical power then being transmittable, however.

In exemplary embodiments of the present invention, such as illustrated, for example, in FIGS. 1*a* and 1*b*, a multilayer board (3, 4, 5) is used that has a spiral winding in several planes. In that case, for example, the current conduction runs not only in a single, spiral, specific plane, but rather the conduction changes repeatedly between the planes to reduce the skin effect. That means that after a short conductor-track section, a change is made to a next plane of the board. There, a short conductor-track section is traversed again, and then in turn a change is made. In this manner, a quasi-twisted current conduction is obtained which, as far as the basic principle is concerned, corresponds to a litz wire, thus, a multiple bundle of mutually insulated current leads. The winding thus obtained is therefore quasi-twisted.

Figure 2:
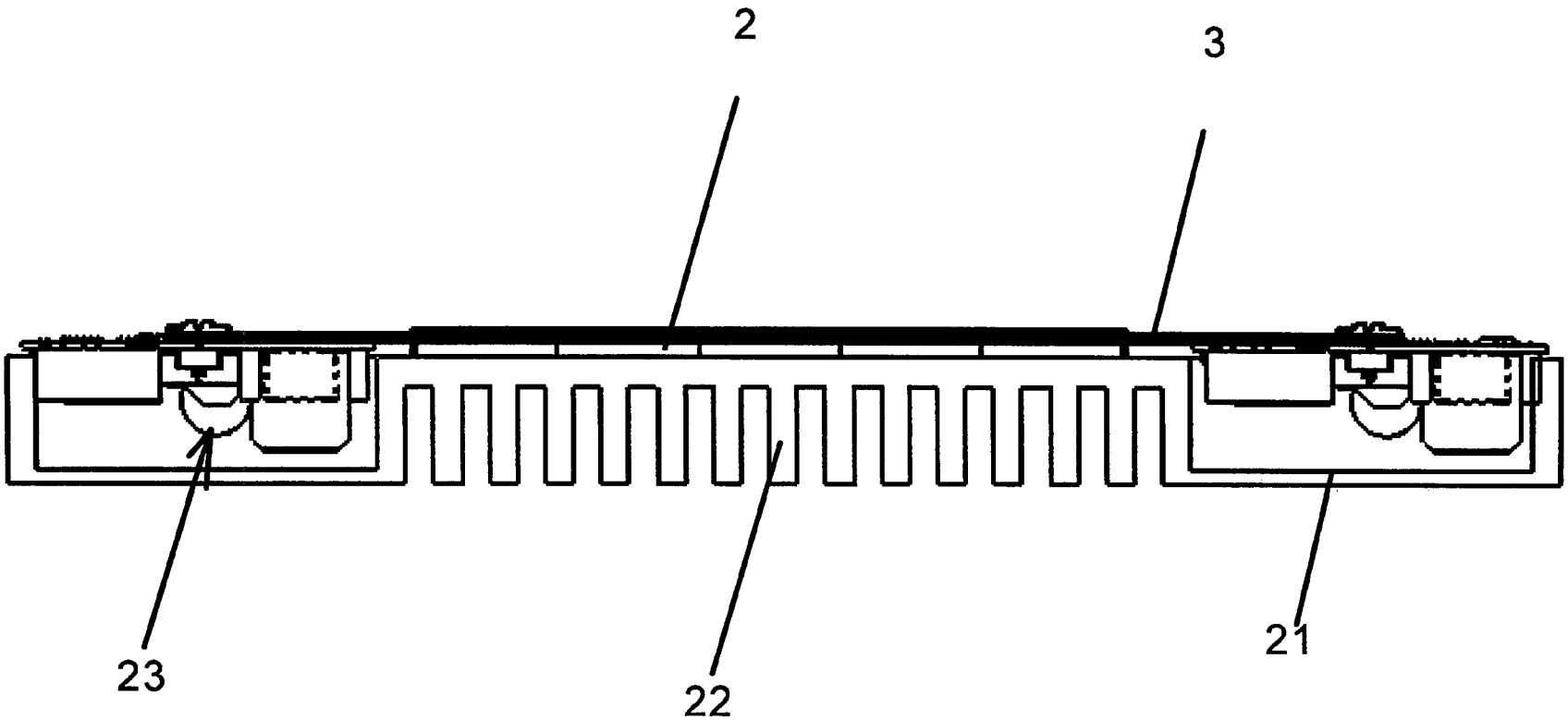
FIG. 2 is a schematic view of an entire structure of a transmitter head together with a board bearing a winding.

FIG. 2 illustrates the entire structure of the transmitter head together with board 3 bearing the winding. Board 3 also bears electronic components 23 and has the conductor tracks.

Board 3 and ferrite cores 4 are joined to a housing part 21 that also has cooling fins 22 for heat dissipation.

Figure 3:
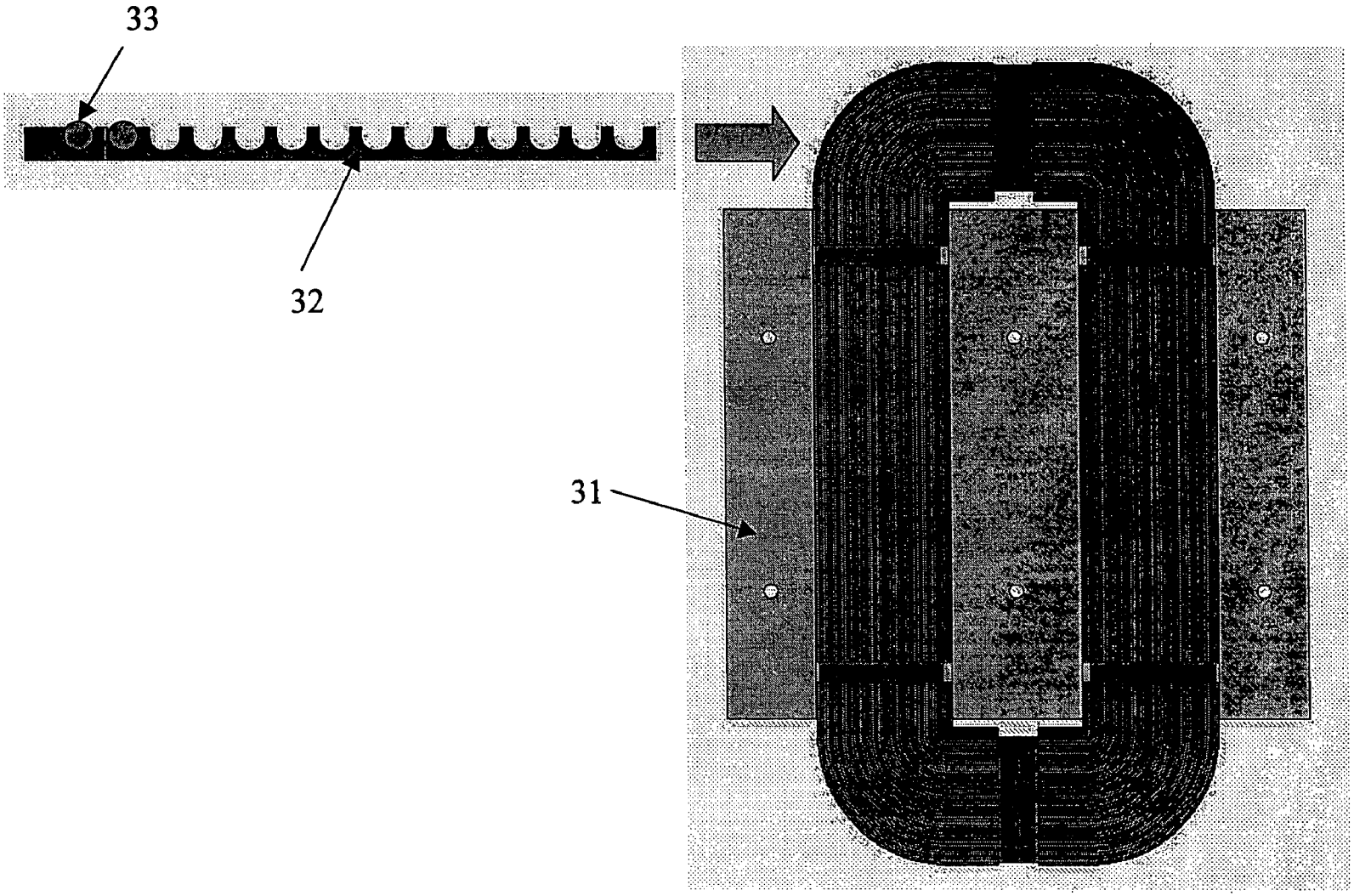
FIG. 3 is a schematic view of an example embodiment of the present invention.
Figure 3A:
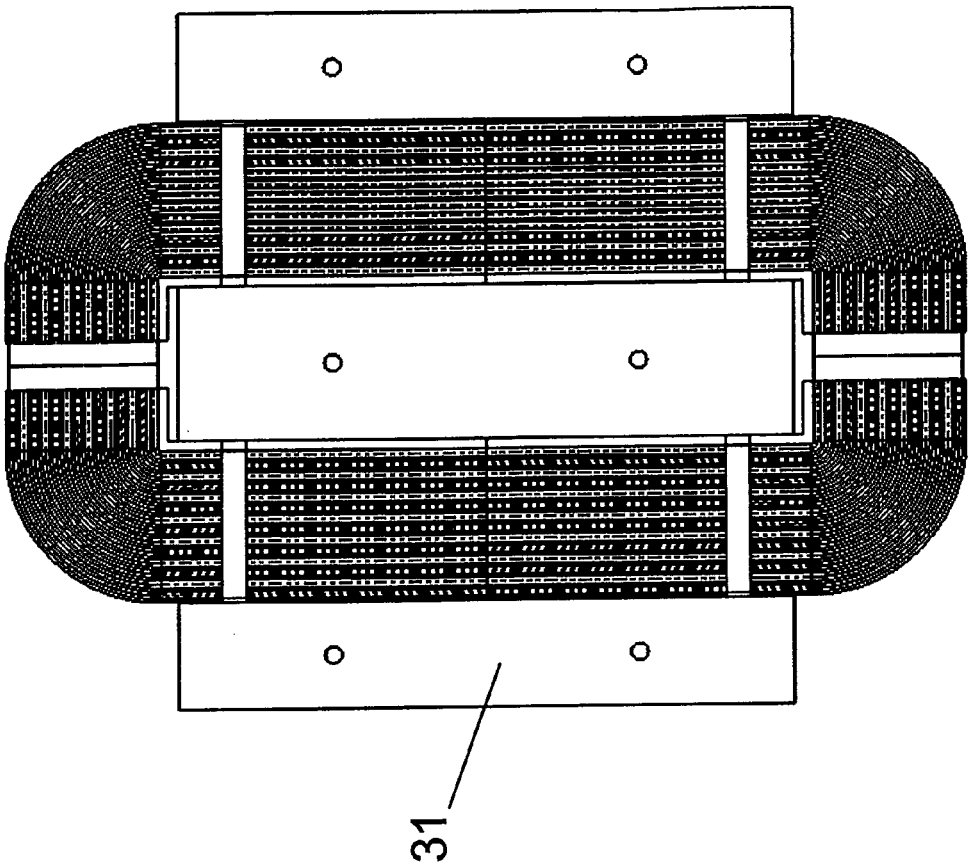
FIG. 3*a* is a schematic view of an example embodiment of the present invention.
Figure 3A:
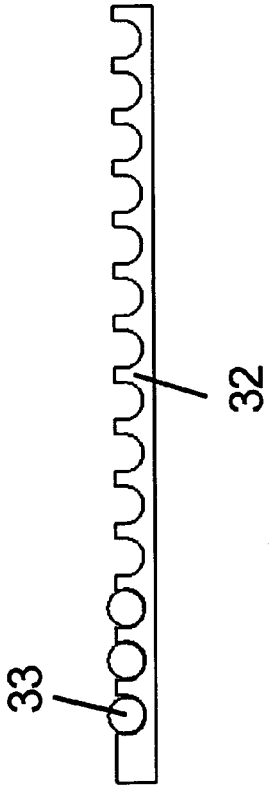

FIG. 3 illustrates an exemplary embodiment according to the present invention. Disposed on ferrite core 31 are plastic molded parts 32, in whose depressions, litz wires 33 are embedded. The litz wires are missing in FIG. 3*a*. In the left upper half of FIGS. 3 and 3*a*, a symbolic intersection through plastic molded parts 32 is illustrated, with the indication of two inserted litz wires 33. Plastic molded parts 32 facilitate the insertion of litz wires 33. Ferrite core 31 is E-shaped, and the winding is implemented about the middle limb of the E. The three limbs of the E are very short, e.g., as short as the height of the winding.

Figure 4:
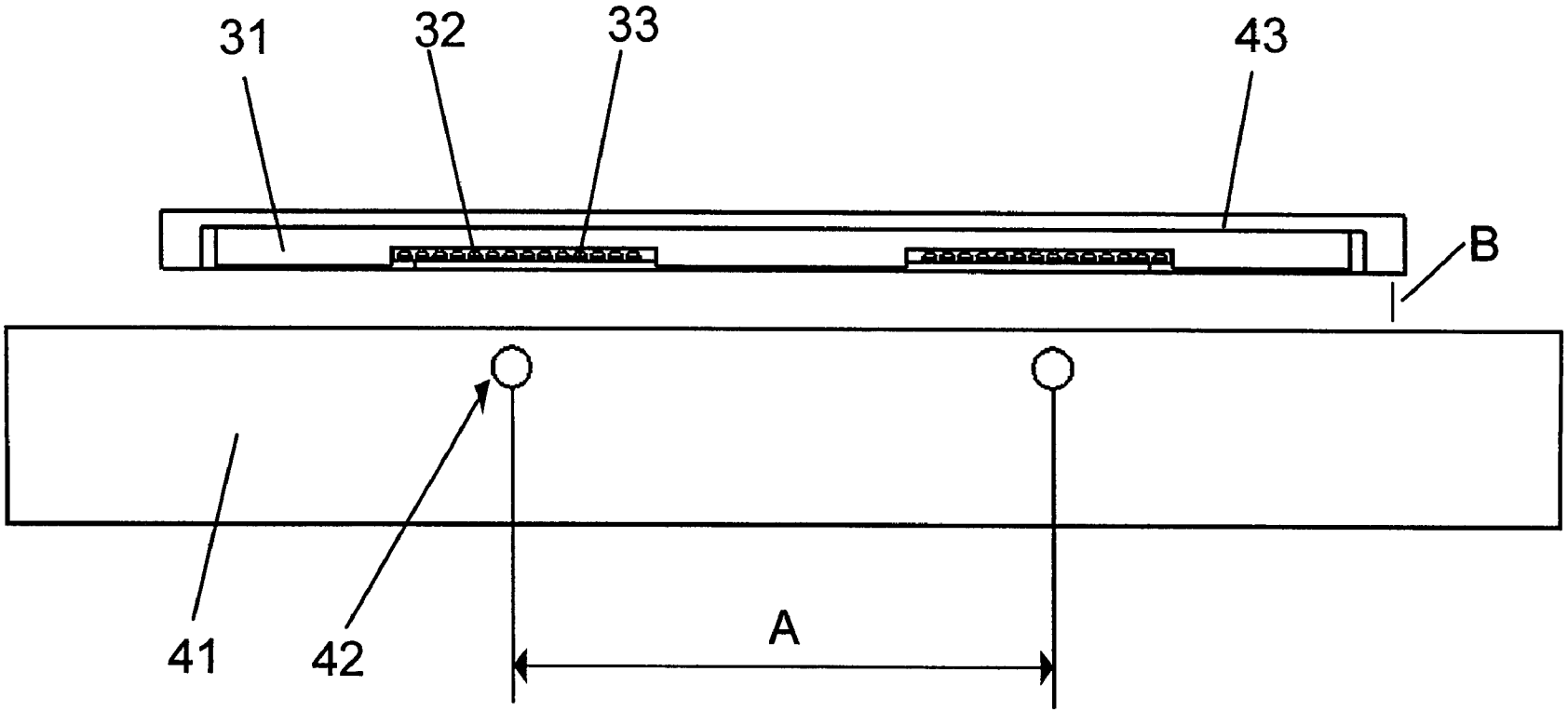
FIG. 4 is a schematic view of a part for inductive energy transmission of a system.

FIG. 4 illustrates the part for the inductive energy transmission of the system. Embedded in floor 41 are two line conductors 42, constructed from litz wire, which have a mutual distance A of, e.g., 140 mm. In exemplary embodiments of the present invention, values from 100 mm to 200 mm may be provided.

The flat transmission head, provided in a housing part 43, has a maximum distance B to floor 41 of, e.g., 15 mm, thus approximately one tenth of distance A of the line conductors. Instead of a tenth, values between 7% to 12% may be possible.

These indicated geometric features may be achieved by arranging the winding to be flat. The lines of the winding are in one plane and do not cross over each other.

In exemplary embodiments of the present invention, plastic molded parts 32 are arranged as modules able to be joined to one another, whose depressions are formed such that the litz wire is either insertable into straight lines or into circular-arc pieces. To that end, both the straight and the circular-arc-type shapes are impressed as depression into the original plastic part such that protuberances remain which are partially interrupted relative to each other, thus do not all directly connect together.

The transmitter head may be incorporated in a vehicle or machine part which is relatively movable with respect to the floor.

The system for contactless energy transmission may operate according to the electronic and electrical features described, for example, in German Published Patent Application No. 44 46 779, German Published Patent Application No. 100 53 373 and/or German Published Patent Application No. 197 35 624, and may be correspondingly designed. In contrast to these documents, however, the power transmission, e.g., the transmitter head, may be implemented with particularly small unit volume.

What is claimed is:

1. A transmitter head for a system for contactless energy transmission, comprising:

at least one ferrite core including an at least partially E-shaped geometry;

a support connected to the ferrite core; and a flat winding disposed about one limb of the E-shaped geometry of the ferrite core and arranged as conductor track sections on a multilayer board having a plurality of planar layers;

wherein the flat winding changes to another planar layer of the multilayer board after each conductor track section.

2. The transmitter head according to claim 1, wherein the multilayer board includes electronic components.

3. The transmitter head according to claim 1, wherein the multilayer board is joined to a housing part that includes a cooling device.

4. The transmitter head according to claim 3, wherein the cooling device includes at least one of (a) cooling fins and (b) cooling fingers.

5. The transmitter head according to claim 1, further comprising at least one plastic part disposed on the ferrite core, the flat winding arranged in depressions formed in the plastic part.

6. A system for contactless energy transmission, comprising:

a transmitter head including:

at least one ferrite core including an at least partially E-shaped geometry;

a support connected to the ferrite core; and a flat winding disposed about one limb of the E-shaped geometry of the ferrite core and arranged as conductor track sections on a multilayer board having a plurality of planar layers;

wherein the flat winding changes to another planar layer of the multilayer board after each conductor track section;

a primary-conductor arrangement including at least two primary conductors extending parallel to each other; and at least one secondary-winding arrangement electromagnetically coupled to the primary-conductor arrangement;

wherein:

the secondary-winding arrangement and the primary-conductor arrangement are mechanically separated from each other;

the secondary-winding arrangement is movable in a longitudinal direction; and the secondary-winding arrangement including at least one secondary coil taking the form of the flat winding and arranged in a plane located parallel to a plane accommodating the primary-conductor arrangement.

7. The system according to claim 6, wherein the primary conductors are arranged one of (a) as line conductors and (b) as flat conductors having a surface normal that is perpendicular to the plane accommodating the secondary-winding arrangement.

8. The system according to claim 6, wherein the secondary-winding arrangement is arranged at a lower side of a floor of a vehicle.

9. the system according to claim 6, wherein the secondary-winding arrangement is embedded in a potting compound.

10. The system according to claim 6, wherein the primary-conductor arrangement is arranged in a stationary manner in a near-surface region of a travel path.

11. The system according to claim 6, wherein at least one of (a) the primary-conductor arrangement and (b) the secondary-winding arrangement is at least partially formed of litz-wire material.

12. The system according to claim 6 wherein the at least two primary conductors are line conductors arranged in a floor at a distance A from each other; and wherein a distance from the transmitter head to the floor is between 0.05*A and 0.2*A.

* * * * *